US006137394A

United States Patent [19]

Holmes et al.

[11] Patent Number: 6,137,394

[45] Date of Patent: Oct. 24, 2000

[54] GROUND INSULATION FOR COILS

[75] Inventors: Carl Alfred Holmes, Erie; Robert Michael Koca, Fairview; William Donald Fisher, Erie, all of Pa.

[73] Assignee: General Electric Company, Erie, Pa.

[21] Appl. No.: 09/300,243

[22] Filed: Apr. 27, 1999

[51] Int. Cl.[7] ..... H01F 27/28; H01F 27/29

[52] U.S. Cl. ..... 336/208; 336/195; 336/192; 336/198

[58] Field of Search ..... 336/208, 198, 336/192, 209, 60, 90, 195, 199

[56] References Cited

U.S. PATENT DOCUMENTS 3,070,766 12/1962 Purdy .
3,842,193 10/1974 Johnson ..... 174/120 C
3,868,766 3/1975 Gramlich et al. ..... 29/596
4,678,699 7/1987 Kritchevsky et al. ..... 428/175
4,714,576 12/1987 Cotton et al. ..... 264/46.5

*Primary Examiner*—Michael L. Gellner
*Assistant Examiner*—Anh Mai
*Attorney, Agent, or Firm*—Ann Agosti; David Risley; Carl A. Rowold

[57] ABSTRACT

A bobbin for insulating a coil including a base portion comprising an electrically insulative material having an inner surface, an outer surface, an outer periphery, and a pole opening (54). An inner flange extends outwardly from the base portion in a first direction from the pole opening and at least partially defines the pole opening. Moreover, an outer flange extends outwardly from the base portion in the first direction from the outer periphery of the base portion. With this configuration, the bobbin is sized and configured to be placed on a side of the coil to provide ground insulation thereto.

15 Claims, 3 Drawing Sheets

GROUND INSULATION FOR COILS

BACKGROUND OF THE INVENTION

The invention generally relates to insulated coils for coil and pole assemblies. More particularly, the invention relates to ground insulation for these coils.

Coil and pole assemblies normally include a magnetizing coil including of a plurality of turns of copper wire or strap which surround a magnetizable ferrous metal pole. The coil is electrically insulated from the pole with a material or materials known as ground insulation. Typically, ground insulation is applied to the coil by wrapping the coil with insulation tape. The insulation tape normally is carefully wrapped layer upon layer about the coil, inside and out, by hand. Armor tape is then wrapped about the insulation tape to provide a protective layer for the insulation tape. During this wrapping, thermally resistant strips of material such as NOMEX® brand fiber products (NOMEX is a trademark of DuPont Co.) commonly referred to as shims, are added to the top and bottom surfaces of the coil to both ensure the correct coil height and to provide the correct coil dimensions for attachment to a machine frame.

The aforementioned insulating process is time consuming and requires a large amount of manual labor. It can be appreciated that it would be advantageous to have insulation that avoids these and other problems.

BRIEF SUMMARY OF THE INVENTION

A preferred embodiment of the present invention substantially avoids the aforementioned difficulties associated with the insulating of conventional coils. Generally speaking, this embodiment relates to a bobbin for insulating a coil. The bobbin includes a base portion comprising an electrically insulative material having an inner surface, an outer surface, an outer periphery, and a pole opening. An inner flange extends outwardly from the base portion in a first direction from the pole opening and at least partially defines the pole opening. Moreover, an outer flange extends outwardly from the base portion in the first direction from the outer periphery of the base portion. With this configuration, the bobbin is sized and configured to be placed on a side of the coil to provide ground insulation thereto.

The objects, features, and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE INVENTION

Figure 1:
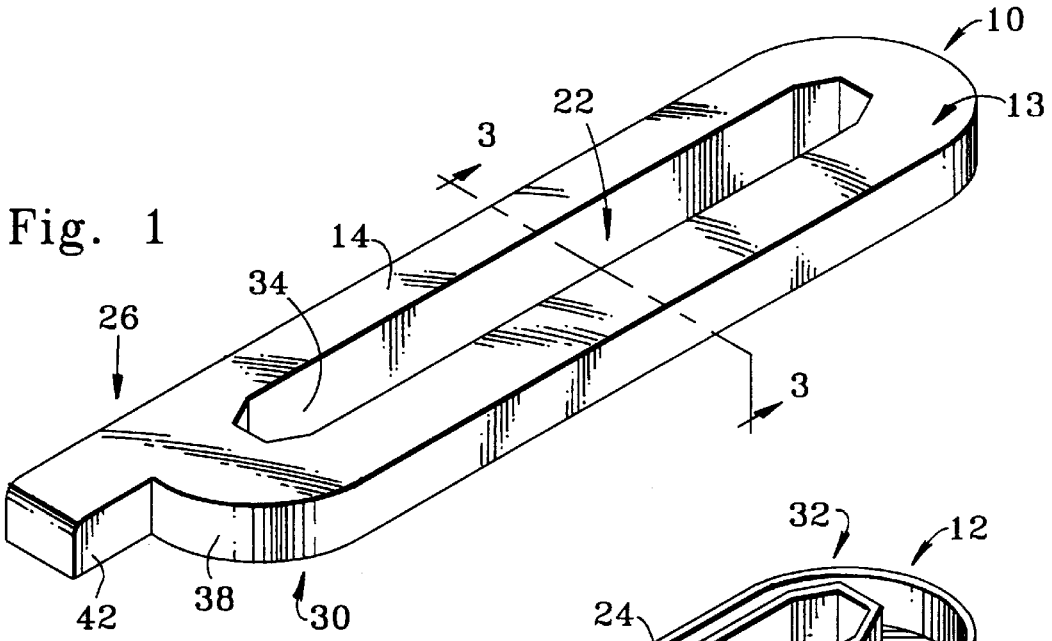
FIG. 1 is a perspective view of a frame side bobbin.
Figure 2:
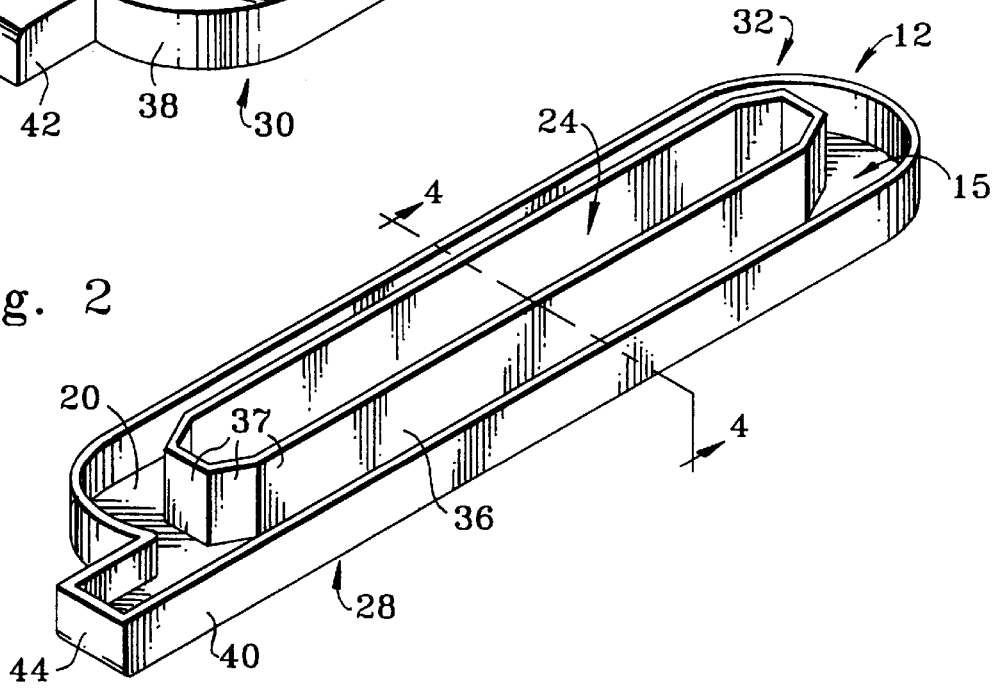
FIG. 2 is a perspective view of a pole side bobbin.
Figure 3:
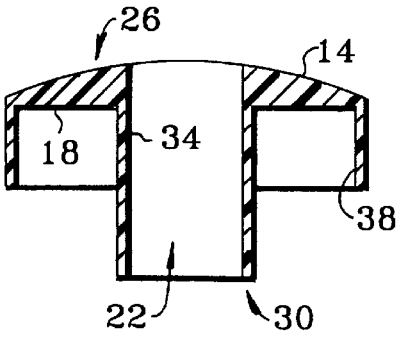
FIG. 3 is a cross-sectional view of the frame side bobbin of FIG. 1 taken along line 3—3.
Figure 4:
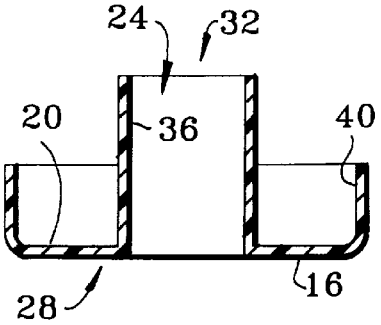
FIG. 4 is a cross-sectional view of the pole side bobbin of FIG. 2 taken along line 4—4.

Referring now in more detail to the drawings, in which like numerals indicate corresponding parts throughout the several views, FIGS. 1–4 illustrate a pair of bobbins for use in providing ground insulation to a coil. Specifically, FIGS. 1 and 3 illustrate a frame side bobbin 10 which is adapted to insulate the coil from the frame, and FIGS. 2 and 4 illustrate a pole side bobbin 12 which is adapted to insulate the coil from its pole. Each bobbin 10, 12 preferably is comprised of a polymeric material that can be molded into the desired shape. Most preferably, the bobbins 10, 12 are comprised of a sheet molding compound (SMC) comprising a glass fiber filler and crosslinked polymeric material. Presently deemed acceptable, for example, is a material known as QC3450 supplied by Quantum Composites. As will be appreciated by those having ordinary skill in the art, alternative durable, heat resistant materials could be substituted for this preferred material, if desired.

As shown in FIGS. 1–4, each bobbin 10, 12 comprises a base portion 13, 15 that includes an outer surface 14, 16, as well as an inner surface 18, 20. As illustrated in FIGS. 3 and 4, the outer surface 14 of the frame side bobbin 10 is substantially arcuate in shape so as to be adapted to follow the contours of the arcuate inner surface of a machine frame (not shown), while the outer surface 16 of the pole side bobbin 12 is substantially planer in shape so as to be adapted to receive a planar flange portion of a pole (not shown). The thickness of the material between the outer and inner surfaces 14 and 18 of the frame side bobbin 10 typically is substantially larger than the thickness of the material between outer surface 16 and inner surface 20 of the pole side bobbin 12. This difference in thickness is due to the distinct purposes each of these bobbins 10, 12 serve. Specifically, the frame side bobbin 10 is to be positioned between a planar side of the insulated coil and the arcuate inner surface of the frame and therefore must have surfaces that conform to both. The pole side bobbin 12, on the other hand, is to be positioned between a planar flange portion of the pole and another planar side of the coil and therefore can be uniform in thickness. Despite these preferred configurations for the bobbins 10, 12, persons having ordinary skill in the art will appreciate that the bobbins could comprise alternative configurations depending upon the size and shape of both the coil to be insulated and the frame in which the coil will be installed.

As indicated most clearly in FIGS. 1 and 2, each bobbin 10, 12 further includes a pole opening 22, 24. Each of these openings 22, 24 extends through the base portion 13, 15 from a top side 26, 28 of the bobbin 10, 12 to a bottom side 30, 32 of the bobbin. The periphery of the openings 22, 24 is defined by inner flanges 34, 36. Typically, each inner flange 34, 36 is continuous so as to travel the full extent of the pole openings 22, 24 and, in a preferred arrangement, is shaped so as to be adapted to follow the contours of the pole that is to be inserted within the insulated coil. For example, as shown in FIGS. 1 and 2, the inner flanges 34, 36 can comprise a plurality of elongated planer portions 37.

In addition to the inner flanges 34, 36 provided on the frame side bobbin 10 and the pole side bobbin 12, respectively, each bobbin further includes an outer flange 38, 40. Like the inner flanges 34, 36, the outer flanges 38, 40 typically are continuous, but trace the outer periphery of each base portion 13, 15. Each bobbin 10, 12 typically further includes a lead portion 42, 44 that is adapted to fit about and protect terminal leads (shown as 19 and 21 in FIG. 5) that extend from the coil. Although the shape of these portions will be dictated by the particular size and shape of the coil terminal leads, by way of example, the lead portions 42, 44 can be substantially elongated and extend outwardly from an end of each bobbin 10,12 as indicated in FIGS. 1 and 2.

Figure 5:
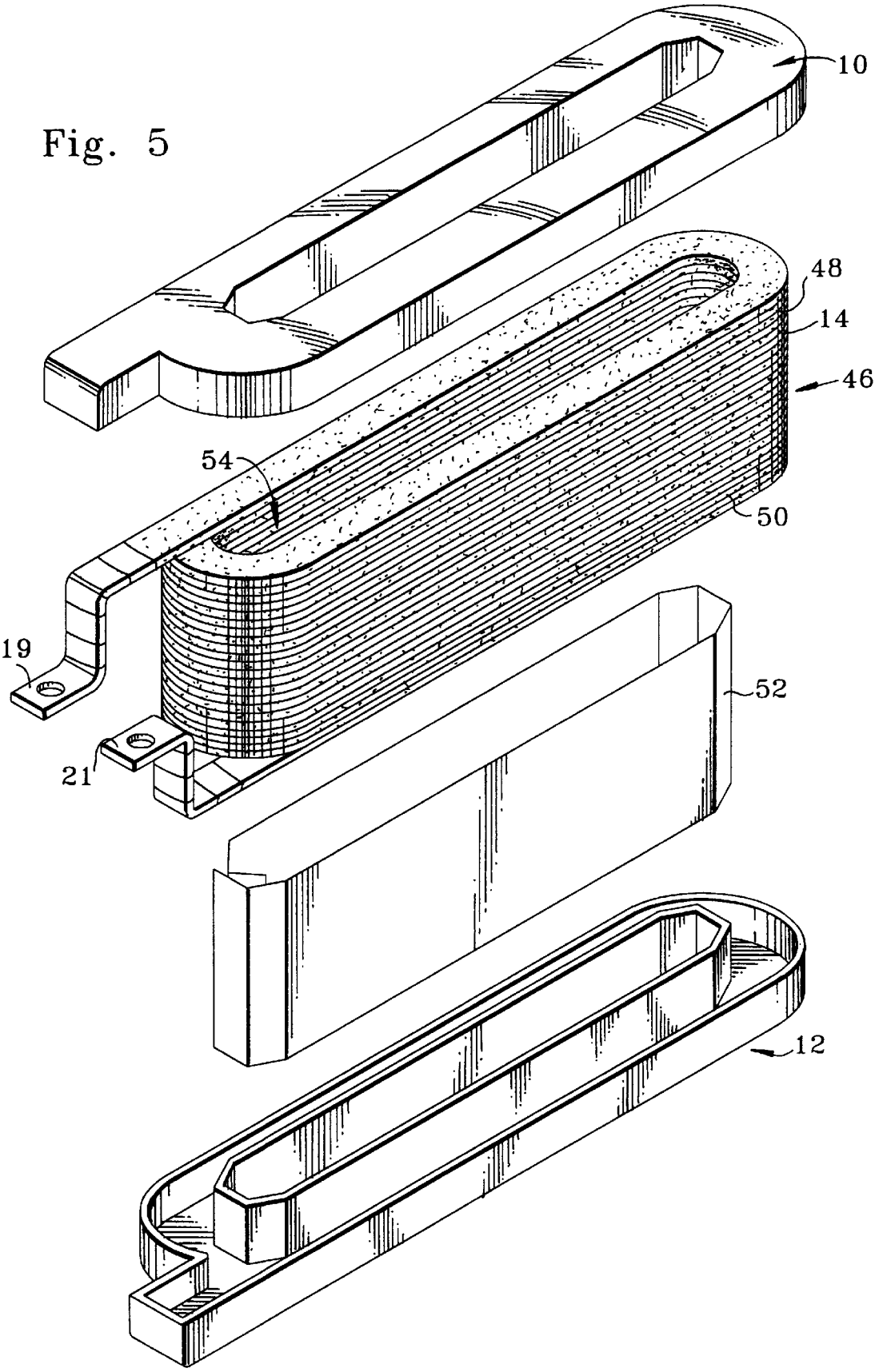
FIG. 5 is an exploded perspective view of an example application of the bobbins of FIGS. 1 and 2.
Figure 6:
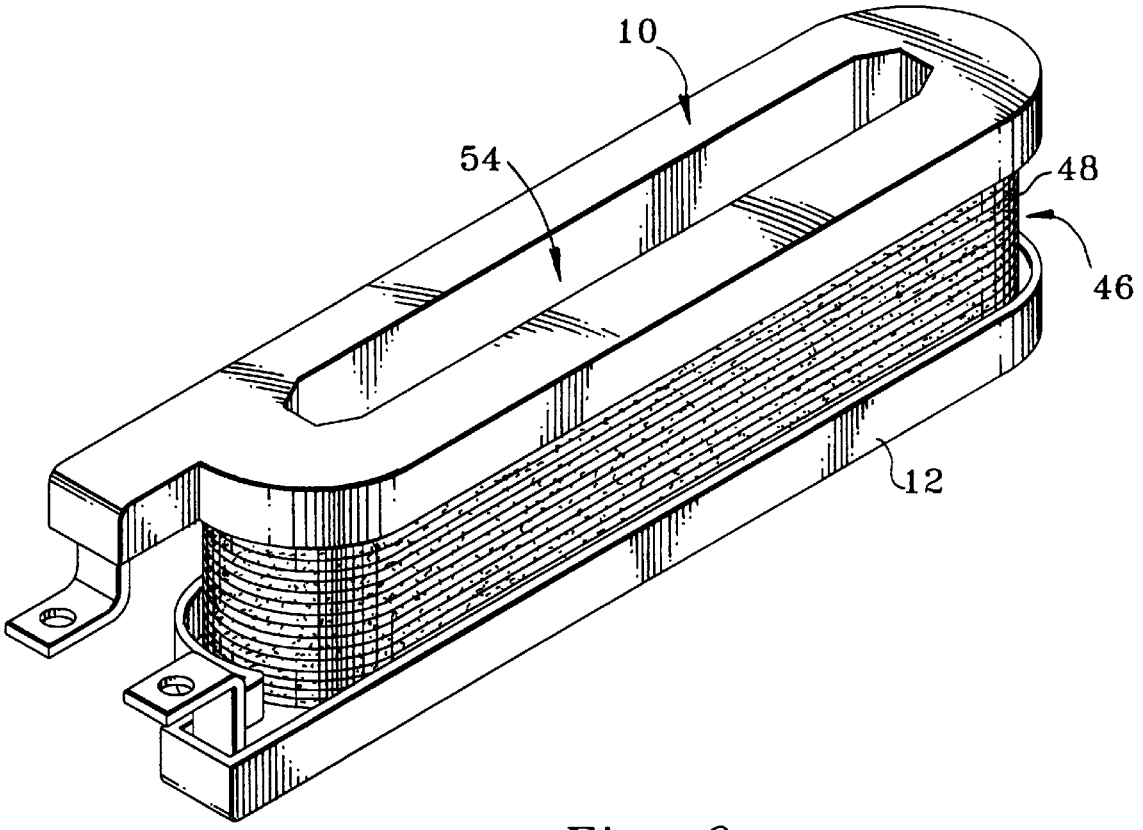
FIG. 6 is an assembled perspective view of the example of FIG. 5.

FIGS. 5 and 6 illustrate an example application of the bobbins 10, 12. These figures show a powder coated coil 46 that is ground insulated with the bobbins 10, 12. This arrangement is described in detail in commonly assigned U.S. patent application Ser. No. 09/300,242, entitled Insulated Coil and Coiled Frame and Method for Making Same, GE Docket No. 20-TS-1931, filed concurrently herewith and hereby incorporated by reference into the present disclosure. As described in this patent application, the insulated coil 46 comprises an electrically conductive coil 48 that is provided with a cured coating of electrically insulative material such as a powder coating material 50. The insulated coil 46 further can include an auxiliary pole insulator 52 that is adapted to fit within a pole opening 54 of the coil. As indicated in FIG. 5, this insulator 52 specifically is adapted for insertion in the pole opening 54 between the bobbins 10, 12. Although not necessary to every application, this insulator 52 adds an additional measure of ground insulation between the insulated coil and its associated pole. When this insulator 52 is used, typically it comprises a sheet of aramid material such as NOMEX® brand fiber products.

Used in this manner, the bobbins 10, 12 described above provide ground insulation to the coil 46 without the time consuming, labor intensive procedures of the prior art. This reduction in time and labor greatly reduces the costs of construction for each coil.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, although described and illustrated in use with a powder coated coil by way of example, it is to be appreciated that the bobbins of the present invention could be used with alternatively insulated coils, for instance bare midriff insulated coils.

What is claimed is:

1. A bobbin for insulating a coil, comprising:

a base portion comprising an electrically insulative material having an inner surface, an outer surface, an outer periphery, and a pole opening;

an inner flange that extends outwardly from the base portion in a first direction from the pole opening, the inner flange at least partially defining the pole opening;

an outer flange that extends outwardly from the base portion in the first direction from the outer periphery of the base portion; and a lead portion extending outwardly from the base portion the lead portion being adapted to at least partially encapsulate a terminal lead of the coil;

wherein the bobbin is sized and configured to be placed on a side of the coil to provide ground insulation thereto.

2. The bobbin of claim 1, wherein the inner surface and the outer surface of the base portion are substantially parallel to one another such that the base portion is substantially uniform in thickriess.

3. The bobbin of claim 2, wherein the inner surface and the outer surface are substantially planar in shape.

4. The bobbin of claim 1, wherein the outer surface of the base portion is substantially arcuate in shape and the inner surface of the base portion is substantially planar in shape.

5. The bobbin of claim 4, wherein the outer surface is adapted to follow the contours of a magnet frame.

6. The bobbin of claim 1, wherein the bobbin is formed of a polymeric material.

7. The bobbin of claim 6, wherein the bobbin is formed from a sheet molding compound.

8. The bobbin of claim 7, wherein the sheet molding compound includes glass fiber filler and heat resistant crosslinked polymeric material.

9. The bobbin of claim 1, further comprising a lead portion which is adapted to at least partially encapsulate a terminal lead of the coil.

10. An assembly comprising:

two bobbins, each bobbin including a base portion comprising an electrically insulative material having an inner surface, an outer surface, an outer periphery, and a pole opening, an inner flange that extends outwardly from the base portion in a first direction from the pole opening, the inner flange at least partially defining the pole opening, an outer flange that extends outwardly from the base portion in the first direction from the outer periphery of the base portion; and a coil, each bobbin being positioned on a side of the coil to provide ground insulation thereto, the bobbins further being separated so as to not contact each other.

11. The assembly of claim 10 further including an auxiliary pole insulator positioned between the two bobbins in an interior opening of the coil.

12. The assembly of claim 10, wherein the bobbins each is formed of a polymeric material.

13. The assembly of claim 10, wherein the bobbins each is formed from a sheet molding compound.

14. The assembly of claim 13, wherein the sheet molding compound includes glass fiber filler and heat resistant crosslinked polymeric material.

15. A bobbin for insulating a coil, comprising:

a base portion comprising a polymeric sheet molding compound having an inner surface, an outer surface, an outer periphery, and a pole opening;

a continuous inner flange that extends outwardly from the inner surface of the base portion from the pole opening, the inner flange at least partially defining the pole opening;

an outer flange that extends outwardly from the inner surface of the base portion from the outer periphery of the base portion; and a lead portion extending outwardly from the base portion, the lead portion being adapted to at least partially encapsulate a terminal lead of the coil;

wherein the bobbin is sized and configured to at least partially encapsulate a side of the coil to provide ground insulation thereto.

* * * * *